US010662735B2

(12) United States Patent
Clemens et al.

(10) Patent No.: US 10,662,735 B2
(45) Date of Patent: May 26, 2020

(54) WELLBORE ISOLATION DEVICE

(71) Applicant: HALLIBURTON ENERGY SERVICES, INC., Houston, TX (US)

(72) Inventors: Jack Gammill Clemens, Fairview, TX (US); Nathan James Harder, Powell, WY (US); Charles Timothy Smith, McKinney, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 197 days.

(21) Appl. No.: 15/772,015

(22) PCT Filed: Dec. 11, 2015

(86) PCT No.: PCT/US2015/065169

§ 371 (c)(1),
(2) Date: Apr. 27, 2018

(87) PCT Pub. No.: WO2017/099789

PCT Pub. Date: Jun. 15, 2017

(65) Prior Publication Data

US 2018/0320474 A1 Nov. 8, 2018

(51) Int. Cl.

| | |
|---|---|
| ***E21B 33/12*** | (2006.01) |
| ***E21B 33/129*** | (2006.01) |
| ***E21B 33/134*** | (2006.01) |

(52) U.S. Cl.

CPC ..... *E21B 33/1294* (2013.01); *E21B 33/1208* (2013.01); *E21B 33/1293* (2013.01); *E21B 33/134* (2013.01)

(58) Field of Classification Search

CPC ..... E21B 33/1208; E21B 33/1293; E21B 33/1294; E21B 33/134

See application file for complete search history.

(56) References Cited

U.S. PATENT DOCUMENTS 3,019,842 A * 2/1962 Nutter ..... E21B 33/1294 166/126

5,947,213 A * 9/1999 Angle ..... E21B 4/18 166/250.01

(Continued)

OTHER PUBLICATIONS

International Search Report and Written Opinion; PCT Application No. PCT/US2015/065169; dated Dec. 11, 2015.

*Primary Examiner* — Daniel P Stephenson
(74) *Attorney, Agent, or Firm* — Polsinelli PC

(57) ABSTRACT

A wellbore isolation device includes a tubular body having an inner bore formed longitudinally therethrough. A plurality of centralizing arms is radially extendible from the tubular body. At least one slip is radially extendible from the tubular body. A sealing assembly that is radially extendible from the tubular body is also included and disposed between the centralizing arms and the slip. The sealing assembly includes a radially extendible elastomeric sealing surface and an anti-extrusion device having at least two support members coupled to opposite longitudinal ends of the elastomeric sealing surface. An equalizing port is also included which is disposed in the tubular body and permits, when opened, fluidic communication between external the tubular body and the inner bore thereby equalizing the pressure between external the tubular body and the inner bore.

18 Claims, 12 Drawing Sheets

(56) References Cited

U.S. PATENT DOCUMENTS

| | | | | |
|---|---|---|---|---|
| 6,405,798 | B1 * | 6/2002 | Barrett | E21B 17/028 166/250.01 |
| 7,798,236 | B2 * | 9/2010 | McKeachnie | E21B 33/134 166/317 |
| 8,256,521 | B2 * | 9/2012 | Swor | E21B 23/06 166/376 |
| 2003/0024712 | A1 | 2/2003 | Neal et al. | |
| 2003/0188869 | A1 | 10/2003 | Tinker | |
| 2005/0269083 | A1 | 12/2005 | Burris, II et al. | |
| 2005/0288819 | A1 * | 12/2005 | de Guzman | F16L 55/32 700/245 |
| 2010/0194049 | A1 * | 8/2010 | Kocurek | E21B 33/03 277/314 |
| 2011/0073310 | A1 | 3/2011 | Clemens et al. | |
| 2013/0092375 | A1 | 4/2013 | Melenyzer | |
| 2013/0333875 | A1 | 12/2013 | Hloorth et al. | |
| 2014/0196913 | A1 * | 7/2014 | Pedersen | E21B 33/1293 166/386 |
| 2014/0262216 | A1 * | 9/2014 | Perry | E21B 17/1014 166/241.6 |
| 2018/0320474 | A1 * | 11/2018 | Clemens | E21B 33/1293 |

* cited by examiner

| Materials | Color |
|---|---|
| First Elastomer | ▨ |
| Second Elastomer | ▧ |

| Materials | Color |
|---|---|
| First Elastomer | ▨ |
| Second Elastomer | ▧ |

WELLBORE ISOLATION DEVICE

CROSS-REFERENCE TO RELATED APPLICATIONS

This application is a national stage entry of PCT/US2015/065169 filed Dec. 11, 2015, said application is expressly incorporated herein in its entirety.

FIELD

The present disclosure relates generally to downhole tools used to isolate portions of a subterranean wellbore.

BACKGROUND

Wellbores are drilled into the earth for a variety of purposes including accessing hydrocarbon bearing formations. A variety of downhole tools may be used within a wellbore in connection with accessing and extracting such hydrocarbons. Throughout the process, it may become necessary to isolate or seal one or more portions of a wellbore. Zonal isolation within a wellbore may be provided by wellbore isolation devices, such as packers, bridge plugs, and fracturing plugs (i.e., "frac" plugs). For example, a wellbore isolation device can be used to isolate the target zone for the hydraulic fracturing operation by forming a pressure seal in the wellbore that prevents the high pressure frac fluid from extending downhole of the wellbore isolation device.

After the downhole operation requiring zonal isolation has been completed, it is often necessary to remove the wellbore isolation device from the wellbore in order to allow hydrocarbon production operations to proceed without being hindered by the presence of the downhole tool. The removal of one or more wellbore isolation devices from the wellbore often involves milling or drilling the wellbore isolation device(s) into pieces followed by retrieval of the pieces of the wellbore isolation device from the wellbore.

BRIEF DESCRIPTION OF THE DRAWINGS

Implementations of the present technology will now be described, by way of example only, with reference to the attached figures, wherein.

DETAILED DESCRIPTION

Figure 1A:
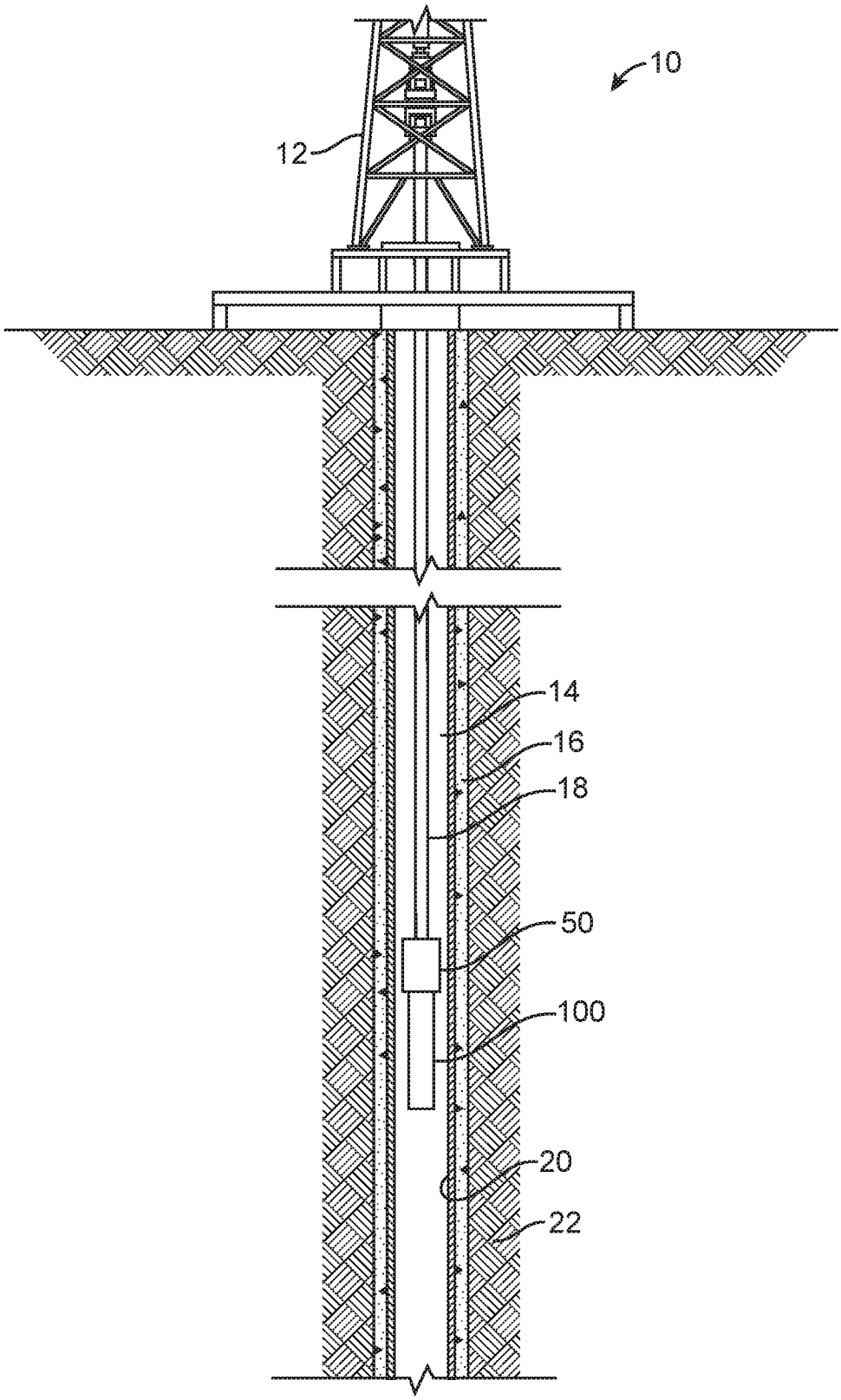
FIG. 1A is a diagram illustrating an exemplary environment for a wellbore isolation device according to the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

In the above description, reference to up or down is made for purposes of description with "up," "upper," "upward," "uphole," or "upstream" meaning toward the surface of the wellbore and with "down," "lower," "downward," "downhole," or "downstream" meaning toward the terminal end of the well, regardless of the wellbore orientation. Correspondingly, the transverse, axial, lateral, longitudinal, radial, etc., orientations shall mean orientations relative to the orientation of the wellbore or tool. The term "axially" means substantially along a direction of the axis of the object. If not specified, the term axially is such that it refers to the longer axis of the object.

Several definitions that apply throughout the above disclosure will now be presented. The term "coupled" is defined as connected, whether directly or indirectly through intervening components, and is not necessarily limited to physical connections. The connection can be such that the objects are permanently connected or releasably connected. The term "outside" or "outer" refers to a region that is beyond the outermost confines of a physical object. The term "inside" or "inner" refers to a region that is within the outermost confines of a physical object. The term "substantially" is defined to be essentially conforming to the particular dimension, shape or other word that substantially modifies, such that the component need not be exact. For example, "substantially cylindrical" means that the object resembles a cylinder, but can have one or more deviations from a true cylinder. The terms "comprising," "including" and "having" are used interchangeably in this disclosure. The terms "comprising," "including" and "having" mean to include, but not necessarily be limited to the things so described.

Disclosed herein is a wellbore isolation device for providing zonal isolation in a wellbore and which equalizes pressure differentials downhole prior to retrieval. The wellbore isolation device can be deployed in a wellbore to a desired location. The wellbore isolation device is activated by a downhole setting tool and transitions the device to a contracted configuration during which a setting assembly is activated, the setting assembly including centralizing arms, a sealing assembly, and slips which extend radially to an extended configuration. The centralizing arms, the sealing assembly, and the slips engage the sides of the wellbore, for example casing. When the centralizing arms are extended radially and engage the wellbore, the wellbore isolation device is positioned substantially in the center of the wellbore with an annulus formed between the tubular body of the isolation device and the casing. The sealing assembly, when extended radially and engaging the wellbore, provides zonal isolation by an impermeable barrier. The sealing assembly includes a radially extendible elastomeric sealing surface made up of at least two elastomers alternatingly coupled along a longitudinal axis. As such, the elastomeric sealing surface provides a seal as well as decreases extrusion of the elastomeric sealing surface. The slips, when extended radially and engaging the wellbore, maintain the position of the wellbore isolation device. The slips prevent the differential pressure that may occur across the sealing assembly from moving the wellbore isolation device.

When the wellbore isolation device is set in place a pressure differential may occur as a result of the sealing function of the sealing assembly. For example, a pressure differential may occur across the sealing assembly in the annulus between the outer housing of the isolation device and the casing. Further, an inner bore extending through the tubular body of the wellbore isolation device may have the same pressure as the annulus downhole below the sealing assembly, and therefore also has a pressure difference with the annulus uphole above the sealing assembly. The wellbore isolation device herein resolves this pressure differential prior to or during retrieval of the device.

The wellbore isolation device disclosed herein can be released and removed from the wellbore. While being released, the wellbore isolation device can transition from the contracted configuration to an expanded configuration. When this occurs, an equalizing port opens to permit fluidic communication from external the tubular body to an inner bore, the inner bore extending longitudinally through the tubular body from an uphole end to a downhole end and longitudinally traverses the sealing assembly. As such, differential pressures are equalized between external the tubular body and the inner bore. Also, fluidic communication is permitted in the inner bore longitudinally across the sealing assembly. Thus, the differential pressures across the sealing assembly can be substantially equalized. Further, the centralizing arms, the sealing assembly, and the slips can radially retract such that the centralizing arms, the sealing assembly, and the slips do not extend from the tubular body of the wellbore isolation device.

The wellbore anchoring assembly can be employed in an exemplary wellbore system 10 shown, for example, in FIG. 1A. A system 10 for anchoring a downhole tool in a wellbore includes a drilling rig 12 extending over and around a wellbore 14. The wellbore 14 is within an earth formation 22 and has a casing 20 lining the wellbore 14, the casing 20 is held into place by cement 16. A wellbore isolation device 100 can be moved down the wellbore 14 via a conveyance 18 to a desired location. A conveyance can be, for example, tubing-conveyed, wireline, slickline, work string, coiled tubing, or any other suitable means for conveying downhole tools into a wellbore. Once the wellbore isolation device 100 reaches the desired location a downhole tool 50 may be actuated to deploy the wellbore isolation device 100.

It should be noted that while FIG. 1A generally depicts a land-based operation, those skilled in the art would readily recognize that the principles described herein are equally applicable to operations that employ floating or sea-based platforms and rigs, without departing from the scope of the disclosure. Also, even though FIG. 1A depicts a vertical wellbore, the present disclosure is equally well-suited for use in wellbores having other orientations, including horizontal wellbores, slanted wellbores, multilateral wellbores or the like. Further, the wellbore system 10 can have a casing already implemented while, in other examples, the system 10 can be used in open hole applications.

Figure 1B:
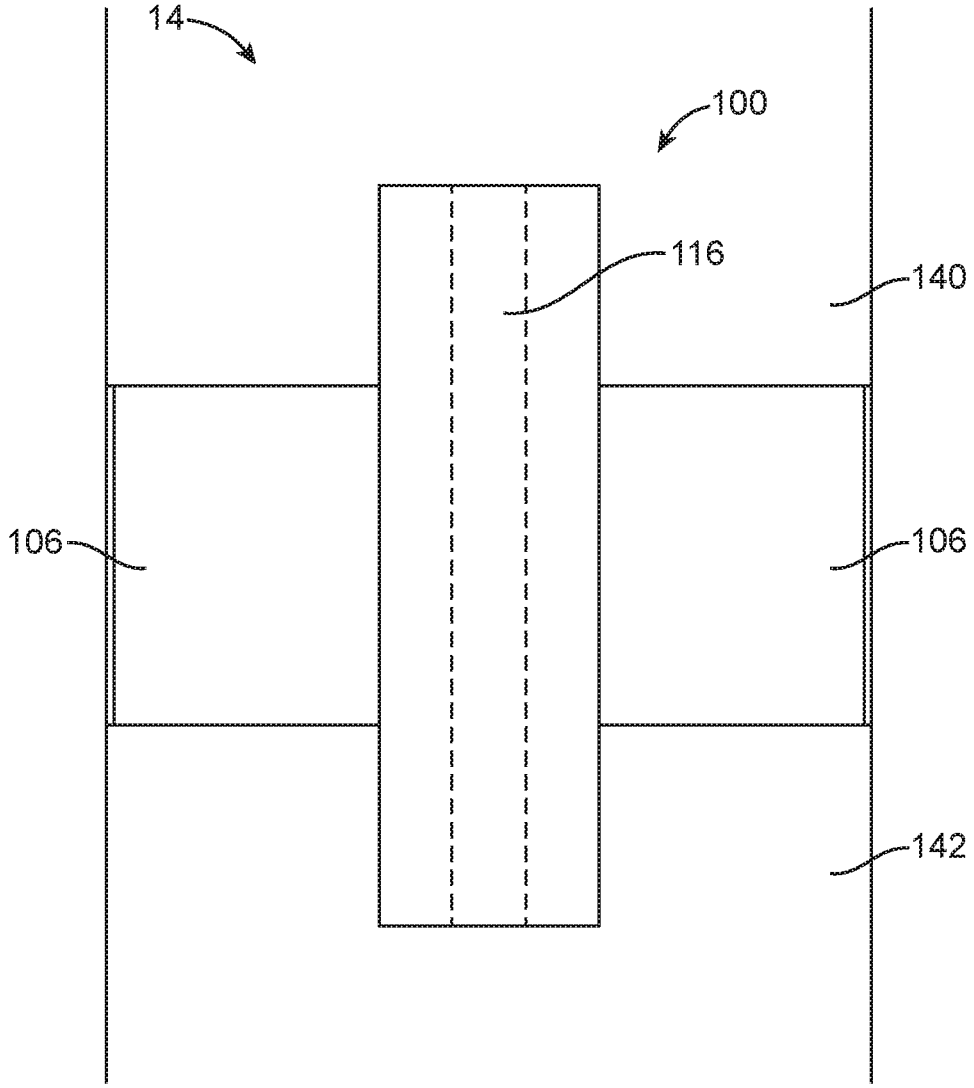
FIG. 1B is a diagram illustrating a wellbore isolation device.

When at a desired location, the wellbore isolation device 100 deploys such that a sealing assembly 106 engages the wellbore 14 (which may include the casing) and creates a seal, as shown in FIG. 1B. The seal then creates zonal isolation in the wellbore 14 with an upper annulus 140 and a lower annulus 142. The upper annulus 140 is uphole from the sealing assembly 106, and the lower annulus 142 is downhole from the sealing assembly 106.

When the wellbore isolation device 100 is set in place, a pressure differential may occur as a result of the sealing function of the sealing assembly 106. A pressure differential may occur across the sealing assembly 106 between the upper annulus 140 and the lower annulus 142. An inner bore 116 extending through the wellbore isolation device 100 may have the same pressure as in the lower annulus 142, and therefore also has a pressure difference with the upper annulus 140. The wellbore isolation device 100 herein resolves this pressure differential prior to or during retrieval of the wellbore isolation device 100.

Figure 2:
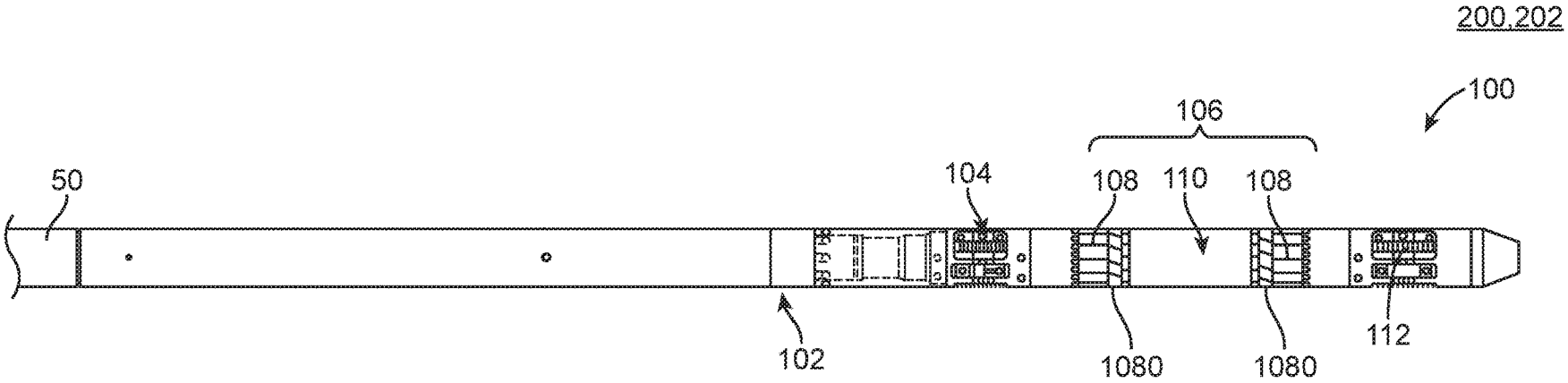
FIG. 2 is a diagram illustrating a wellbore isolation device.

FIG. 2 illustrates a wellbore isolation device 100 in an expanded configuration 202. The wellbore isolation device has an outer housing 12. The outer housing 12 can be circular, ovoid, rectangular, or any suitable shape to form an external shell of the wellbore isolation device 100. In at least one example, the outer housing 12 can be manufactured using cast iron, brass, aluminum, or any other suitable material.

The wellbore isolation device 100 includes a setting assembly, which includes a plurality of centralizing arms 104, at least one slip 112, and a sealing assembly 106. The illustrated example shows the outer housing 102 in an expanded configuration 202. The centralizing arms, the slip 112, and the sealing assembly 106 are in a retracted configuration 200. The centralizing arms 104 are disposed about the wellbore isolation device 100 at equal intervals such that the centralizing arms 104, when radially extended, position the wellbore isolation device 100 substantially in the center of the wellbore.

The wellbore isolation device 100 further includes a sealing assembly 106. The sealing assembly 106, when radially extended, engages the wellbore and prevents fluidic communication across the sealing assembly 106, thus creating zonal isolation in the wellbore. The sealing assembly 106 includes a radially extendible elastomeric sealing surface 110 and an anti-extrusion device 108. The elastomeric sealing surface 110 engages the wellbore and creates a seal thereby preventing fluidic communication across the elastomeric sealing surface 110 in the wellbore. The anti-extrusion device 108 has at least two support members 1080 coupled to opposite longitudinal ends of the elastomeric sealing surface 110. The anti-extrusion device 108 prevents the elastomeric sealing surface 110 from moving and deforming.

The wellbore isolation device 100 also includes at least one slip 112. The at least one slip 112 can extend radially and engage the wellbore, maintaining the position of the wellbore isolation device 100. The at least one slip 112 prevents the differential pressure that may occur across the sealing assembly 106 from moving the wellbore isolation device 100. In at least one example, the wellbore isolation device 100 can have one slip 112. In other examples, the wellbore isolation device 100 can have more than one slip 112, as long as the slips 112 can prevent the wellbore isolation device 100 from moving while engaged in the wellbore.

The sealing assembly 106 is disposed between the centralizing arms 104 and the slip 112. In other examples, the sealing assembly 106, the centralizing arms 104, and the slip 112 can be positioned in any suitable arrangement to create zonal isolation in the wellbore.

The wellbore isolation device 100 is coupled to a downhole tool 50. The downhole tool 50 transports the wellbore isolation device 100 to a desired location and deploys the wellbore isolation device 100. For example, the downhole tool 50 can be a Halliburton DPU® downhole power unit.

Figure 3:
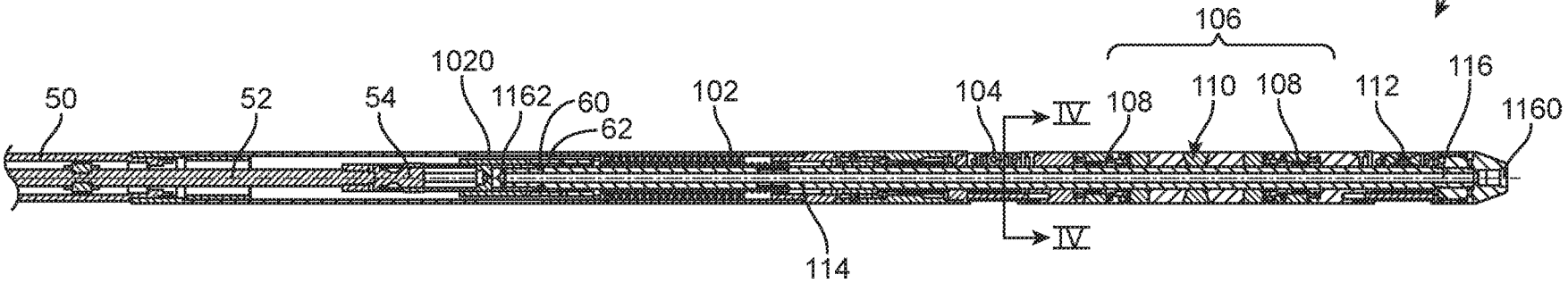
FIG. 3 is a cross-sectional view of a wellbore isolation device.

As illustrated in FIG. 3, downhole tool 50 can include a rod 52 that is coupled to a weak link 54. The weak link 54 has a narrowed portion that is structurally weak. In other examples, the weak link 54 can be connected by a fastener that can be sheared, such as a shear pin, if a force is applied thereon. The weak link 54 is coupled to a tubular body 114. The tubular body 114 is contained within the outer housing 102 and longitudinally traverses the wellbore isolation device 100. The tubular body 114 has an inner bore 116 formed therethrough. The inner bore 116 longitudinally traverses the tubular body 116. The wellbore isolation device 100 has an opening 1160 that permits fluid communication between external the wellbore isolation device and the inner bore 116. The opening 1160 is at a downhole end of the wellbore isolation device 100 opposite the uphole end coupled to the downhole tool 50. In at least one example, the opening 1160 can have an opening and closing mechanism. In other examples, the opening 1160 is an aperture without an opening and closing mechanism.

The wellbore isolation device 100 includes a slidable sleeve 60 which at least partially encircles the tubular body 114. The slidable sleeve 60 includes a first aperture 62. Further, the tubular body 114 includes a second aperture 1162 which is in communication with the inner bore 116. In at least one example, the tubular body 114 can have one aperture to permit fluid communication to the inner bore 116. In other examples, the tubular body 114 can have more than one aperture that permits fluid communication to the inner bore 116.

Further, the outer housing 102 has an outer aperture 1020. The outer aperture 1020 permits fluid communication between external the outer housing 102 and an annulus cavity which is formed between the outer housing 102 and the tubular body 114.

Figure 4:
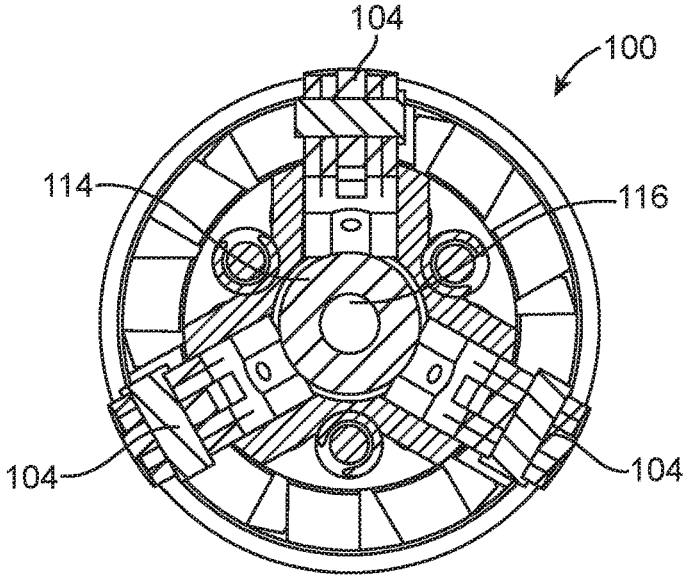
FIG. 4 is a cross-sectional view of a wellbore isolation device taken along line IV-IV of FIG. 3.

FIG. 4 illustrates the centralizing arms 104 disposed about the tubular body 114. A plurality of centralizing arms 104 extend radially from the tubular body 114. In other examples, the centralizing arms 104 can be disposed on the external surface of the outer housing 102. The centralizing arms 104 are positioned about the tubular body 114 such that the centralizing arms 104 are evenly distributed around the circumference of the tubular body 114. Thus, when the centralizing arms 104 radially extend from the tubular body 114 and engage with the wellbore, the wellbore isolation device 100 is positioned substantially in the center of the wellbore. As illustrated, the three centralizing arms 104 are separated by 120 degrees around the circumference of the tubular body 114. In another example, four centralizing arms would be separated by 90 degrees. In yet other examples, the wellbore isolation device 100 can have 2 or more centralizing arms disposed equally about the tubular body 114.

Figure 5A:
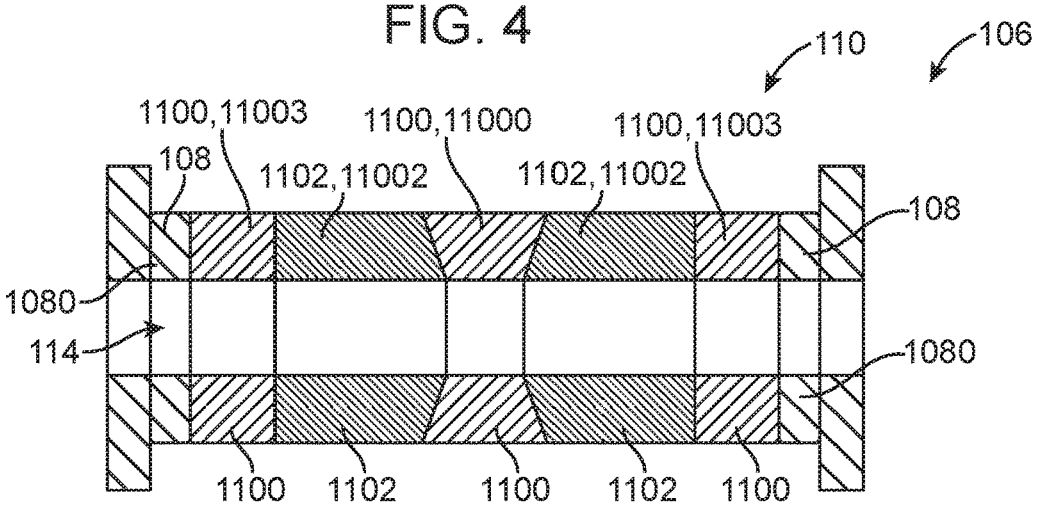
FIG. 5A is a cross-sectional view of an elastomeric sealing surface.
Figure 5B:
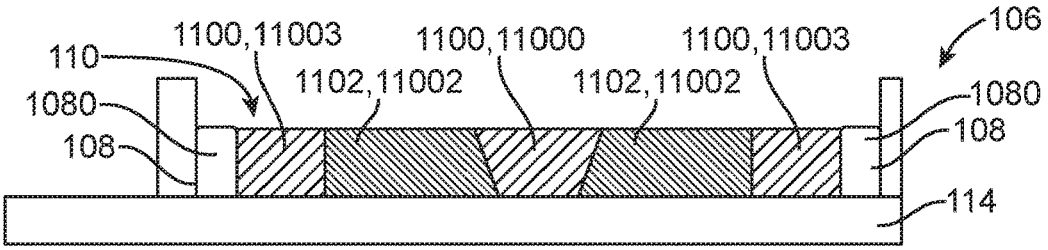
FIG. 5B is a cross-sectional view of an elastomeric sealing surface.

The elastomeric sealing surface 110 of the sealing assembly 106 is illustrated in FIGS. 5A and 5B. FIG. 5A illustrates a cross-section of the elastomeric sealing surface 110. The elastomeric sealing surface 110 at least partially encircles the tubular body 114. The elastomeric sealing surface 110 is made up of a first elastomer 1100 and a second elastomer 1102. The first elastomer 1100 and the second elastomer 1102 are alternately coupled to one another longitudinally along the elastomeric sealing surface 110. The first elastomer 1100 and the second elastomer 1102 can be chemically bonded to one another. In other examples, the first elastomer 1100 and the second elastomer 1102 can be bonded by an adhesive.

In the illustrated example, the elastomeric sealing surface 110 includes five portions along a longitudinal axis. The five portions include a middle portion 11000, two side portions 11002 coupled to opposite sides of the middle portion 11000, and two outer portions 11003 coupled to the two side portions 11002. Each of the two outer portions 11003 forms an outer end of the five portions. In other examples, there can be more than five portions. In yet other examples, there can be less than five portions. The middle portion 11000 and the outer portions 11003 include the first elastomer 1100. The side portions 11002 include the second elastomer 1102.

The second elastomer 1102 is stiffer than the first elastomer 1100. In at least one example, the first elastomer 1100 and the second elastomer 1102 can be composed of HNBR and can have a 25% modulus ratio or stiffness ratio of about 1.9 to about 1 (second elastomer 1102 to first elastomer 1100) when measured at about room temperature, or about 74° F. At about 150° F., the 25% modulus ratio can be about 1.65 to about 1 (second elastomer 1102 to first elastomer 1100). For example, the first elastomer 1100 can be HNBR75-ES-R-18-4 while the second elastomer 1102 can be HNBR90. In other examples, the first elastomer 1100 and second elastomer 1102 can be composed of NBR, FKM, FFKM, Urethane, AFLAS, EPR, EPDM, AEM, ECO, GECO, XNBR, XHNBR, CR, CSM, FVMQ, or any combination thereof. The first elastomer 1100 and the second elastomer 1102 can have substantially the same composition but with different stiffness ratios. In other examples, the first elastomer 1100 and the second elastomer 1102 can have different compositions. The 25% modulus ratio or stiffness ratio can vary between about 1.05 to about 1 and about 50.0 to about 1 (second elastomer 1102 to first elastomer 1100) when measured at either about room temperature or at elevated temperatures.

As illustrated in FIG. 5B, a cross-section of the middle portion 11000 can have a generally trapezoidal shape. The middle portion 11000 has oblique boundaries with the two side portions 11002. A cross-section of the two side portions 11002 can have a generally right-trapezoidal shape. The side portions 11002 can have level boundaries with the outer portions 11003 such that the boundaries between the side portions 11002 and the outer portions 11003 are not at an angle. A cross-section of the two outer portions 11003 can have a generally rectangular shape. The two outer portions 11003 are coupled to the two support members 1080 of the anti-extrusion device 108.

Figure 6A:
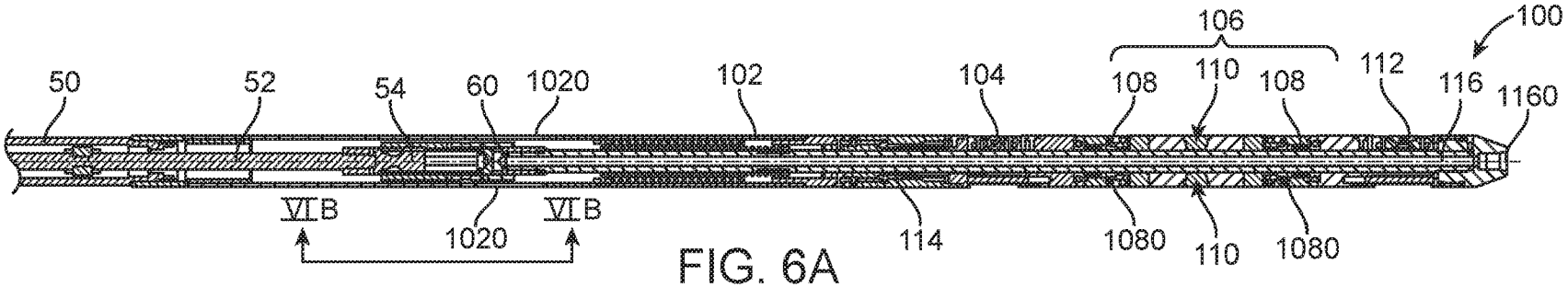
FIG. 6A is a cross-sectional view of a wellbore isolation device.

When the wellbore isolation device 100 is run downhole, i.e., transported to a desired location in the wellbore, the downhole tool 50 deploys the wellbore isolation device 100. As illustrated in FIG. 6A, the slidable sleeve 60 shifts along the tubular body 114 such that the slidable sleeve 60 encircles at least a portion of the weak link 54 and the tubular body 114. In at least one example, the slidable sleeve 60 shifts uphole toward the downhole tool 50. In other examples, the slidable sleeve 60 shifts downhole away from the downhole tool 50.

Figure 6B:
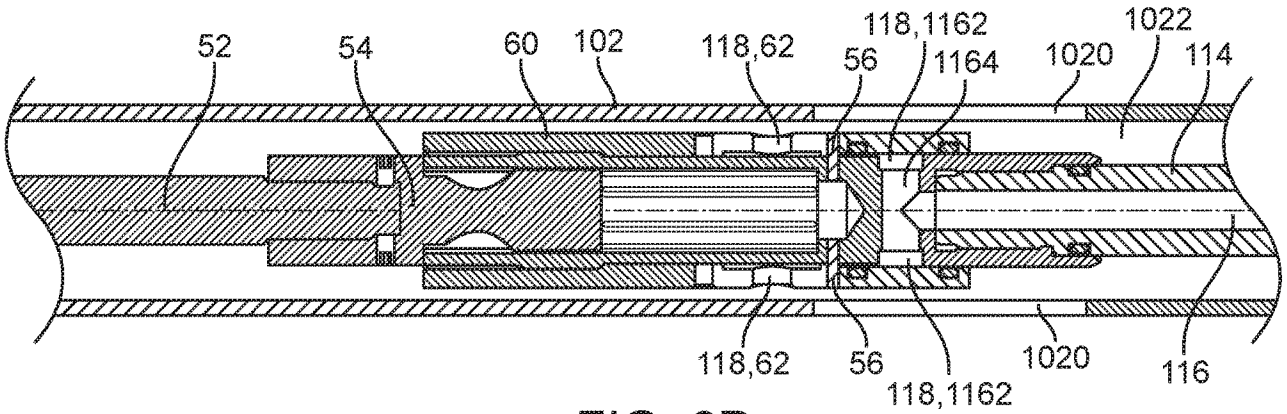
FIG. 6B is an enlarged, cross-sectional view of a wellbore isolation device taken from section VIB-VIB of FIG. 6A.

FIG. 6B illustrates an enlarged view of a portion of the wellbore isolation device 100 that includes the slidable sleeve 60. The slidable sleeve 60, as mentioned above, is encircling at least a portion of the weak link 54 and the tubular body 114. The slidable sleeve 60 is fastened in position to the tubular body 114 by sleeve fasteners 56. The sleeve fasteners 56 are configured to shear off or detach when a breaking force is imparted thereon. In at least one example, the sleeve fasteners 56 can be shear pins. In other examples, the sleeve fasteners 56 can be lock rings, cotter pins, or any other suitable fastener that detaches or shears off when a breaking force is applied.

As shown, the outer aperture 1020 permits fluid communication between external the outer housing 102 and an annulus cavity 1022 which is formed between the outer housing 102 and the tubular body 114.

The illustrated example illustrates the second aperture 1162 on each side of the tubular body 114 that are connected by a channel 1164 which is in communication with the inner bore 116. An equalizing port 118 includes the first aperture 62, and the second aperture 1162 and forms when the first aperture 62 aligns with the second aperture 1162. The equalizing port 118 controls and permits fluid communication between external the tubular body 114 and the inner bore 116. As illustrated in FIG. 6B, the equalizing port 118 is in a closed configuration. The first aperture 62 is not aligned with the second aperture 1162 such that fluid cannot communicate between external the tubular body 114 and the inner bore 116. Slidable sleeve 60 shifts over to cover and close the second aperture 1162. In other examples, the equalizing port 118 can be an aperture with a seal mechanism that opens or closes to allow fluid to flow through the aperture.

The tubular body 114 has an uphole side and a downhole side relative to the sealing assembly 106. The equalizing port 118 is disposed in a side of the tubular body 114 opposite the opening 1160. As such, the equalizing port 118 and the opening 1160 are in communication with the inner bore 116 on opposite sides of the sealing assembly 106. Thus, when the equalizing port 118 and the opening 1160 are open, fluid can bypass the sealing assembly 106 by the inner bore 116. In the illustrated example, the equalizing port 118 is disposed in the uphole side of the tubular body 114, and the opening 1160 is disposed in the downhole side of the tubular body 114. In other examples, the equalizing port 118 can be disposed in the downhole side of the tubular body 114, and the opening 1160 can be disposed in the uphole side of the tubular body 114. If the opening 1160 is open while the equalizing port 118 is closed, the pressure within the inner bore 116 is equal to the pressure external the wellbore isolation device 100. For example, if the opening 1160 is disposed in the tubular body 114 downhole the extended sealing assembly 106, the pressure within the inner bore 116 is equal to the pressure external the tubular body 114 downhole the sealing assembly 106. As such, the pressure external the tubular body 114 uphole the sealing assembly 106 may be different than the pressure within the inner bore 116.

Figure 7A:
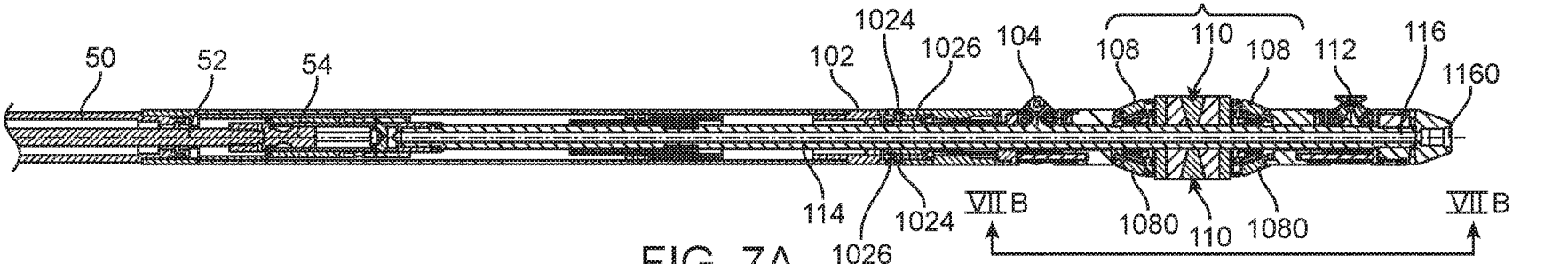
FIG. 7A is a cross-sectional view of a wellbore isolation device.
Figure 7B:
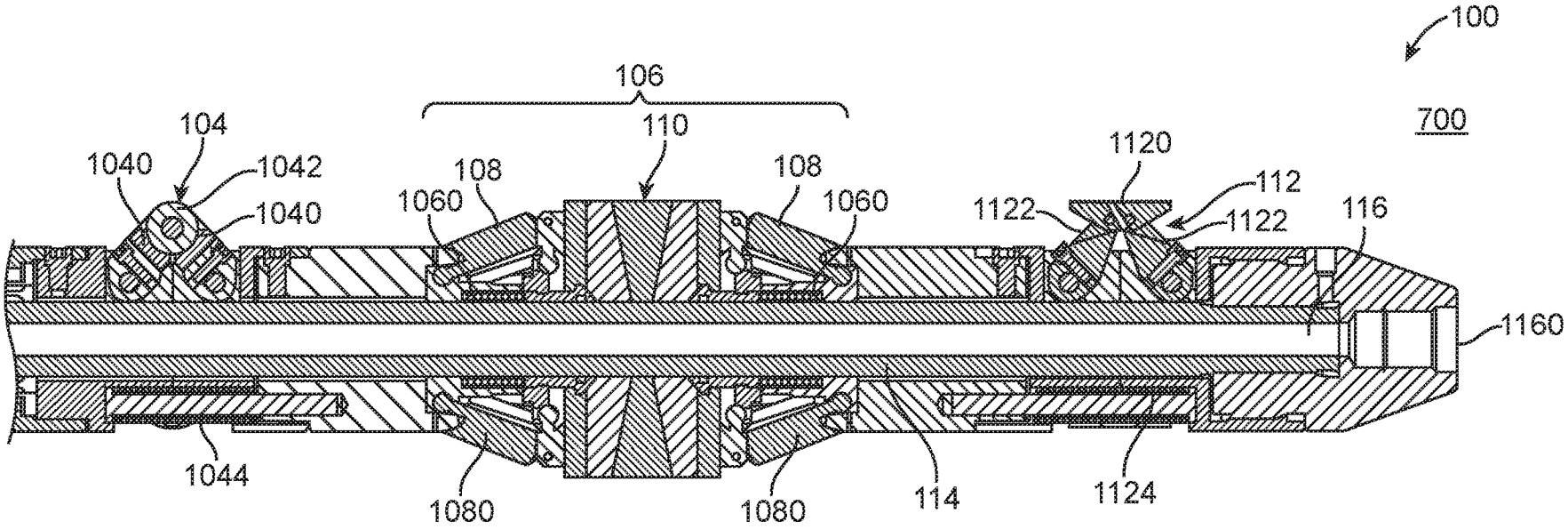
FIG. 7B is an enlarged, cross-sectional view of a wellbore isolation device taken from section VIIB-VIIB of FIG. 7A.

After the weak link 54 and the sleeve fasteners 56 are set, the outer housing 102 is compressed to a contracted configuration 702 as illustrated in FIGS. 7A and 7B. The components of the setting assembly, including centralizing arms 104, the sealing assembly 106, and the slips 112 are radially extended from the tubular body 114 to an extended configuration 700. The outer housing 102 is compressed relative to the tubular body 114 by the downhole tool 50. In at least one example, the outer housing 102 is abutted by the downhole tool 50 while the tubular body 114 is pulled.

As the outer housing 102 is compressed, at least one set of non-helical teeth 1026 shift such that extension of the outer housing 102 is prevented. The non-helical teeth 1026 are angled, allowing motion in one direction only, similar to a ratchet. In the illustrated example, the non-helical teeth 1026 are angled such that compression of the outer housing 102 is the only direction allowed. Thus, the non-helical teeth 1026 maintain the contracted configuration 702 of the outer housing 102, and the centralizing arms 104, the sealing assembly 106, and the slips 112 remain in the extended configuration 700. The non-helical teeth 1026 are fastened to teeth fasteners 1024. The teeth fasteners 1024 maintain communication between the non-helical teeth 1026. The teeth fasteners 1024 can be configured to break or shear when a predetermined force is applied thereon. In at least one example, the teeth fasteners 1024 can be shear pins, shear screws, lock rings, cotter pins, or any other suitable fastener that detaches or shears off when a breaking force is applied.

FIG. 7B illustrates an enlarged view of the setting assembly, including centralizing arms 104, the sealing assembly 106, and the at least one slip 112 in the extended configuration 700. The centralizing arms 104 include two limbs 1040 that are hingedly coupled to each other by a hinge 1042. The centralizing arms 104 are also pivotally coupled to the outer housing 102. When the outer housing 102 is compressed, the two limbs 1040 are also compressed. The limbs 1040 then pivot and radially extend from the outer housing 102 and the tubular body 114. In at least one example, the ends of the limbs 1040 that are coupled by the hinge 1042 are rounded to permit pivoting of the limbs 1040 when compressed. Springs 1044 provide a resistance to the compression of the outer housing 102. For the centralizing arms 104 to radially extend, the compression force must overcome the resistance of the springs 1044.

The at least one slip 112 includes two arms 1122 that are hingedly coupled to an engaging surface 1120. The slip is also pivotally coupled to the outer housing 102. When the outer housing 102 is compressed, the two arms 1122 are also compressed. The two arms 1122 then pivot and radially extend from the outer housing 102 and the tubular body 114. The engaging surface 1120 is also radially extended such that the engaging surface 1120 engages the wellbore and maintains the position of the wellbore isolation device 100.

Springs 1124 further provide a resistance to the compression of the outer housing 102. For the slip 112 to radially extend, the compression force must overcome the resistance of the springs 1124. In other examples, the slip 112 can include an engaging slip and a wedge such that, when compressed, the engaging slip moves relative to the wedge, causing the engaging slip to radially expand outward against the wellbore. In yet other examples, the slip 112 can be any suitable slip that engages the wellbore and prevents movement of the wellbore isolation device 100.

The sealing assembly 106, as mentioned above, includes a radially extendible elastomeric sealing surface 110 and an anti-extrusion device 108 which includes two support members 1080 which prevent movement and deformation of the elastomeric sealing surface 110. Similar to the slip 112 and the centralizing arms 104, the support members 1080, when compressed, pivot radially outward from the tubular body 114. Springs 1060 provide a resistance to the compression of the outer housing 102. For the support members 1080 to radially pivot and extend, the compression force must overcome the resistance of the springs 1060. As the support members 1080 pivot and extend radially, the elastomeric sealing surface 110 also extends radially from the tubular body 114. The composition and structural design of the elastomeric sealing surface 110 also resists the extension and compression force. However, the anti-extrusion device 108 maintains the structure and positioning of the elastomeric sealing surface 110. When extended and engaging the wellbore, the elastomeric sealing surface 110 and the anti-extrusion device 108 provide a seal such that fluid communication is prevented across the sealing assembly 106.

Figure 8A:
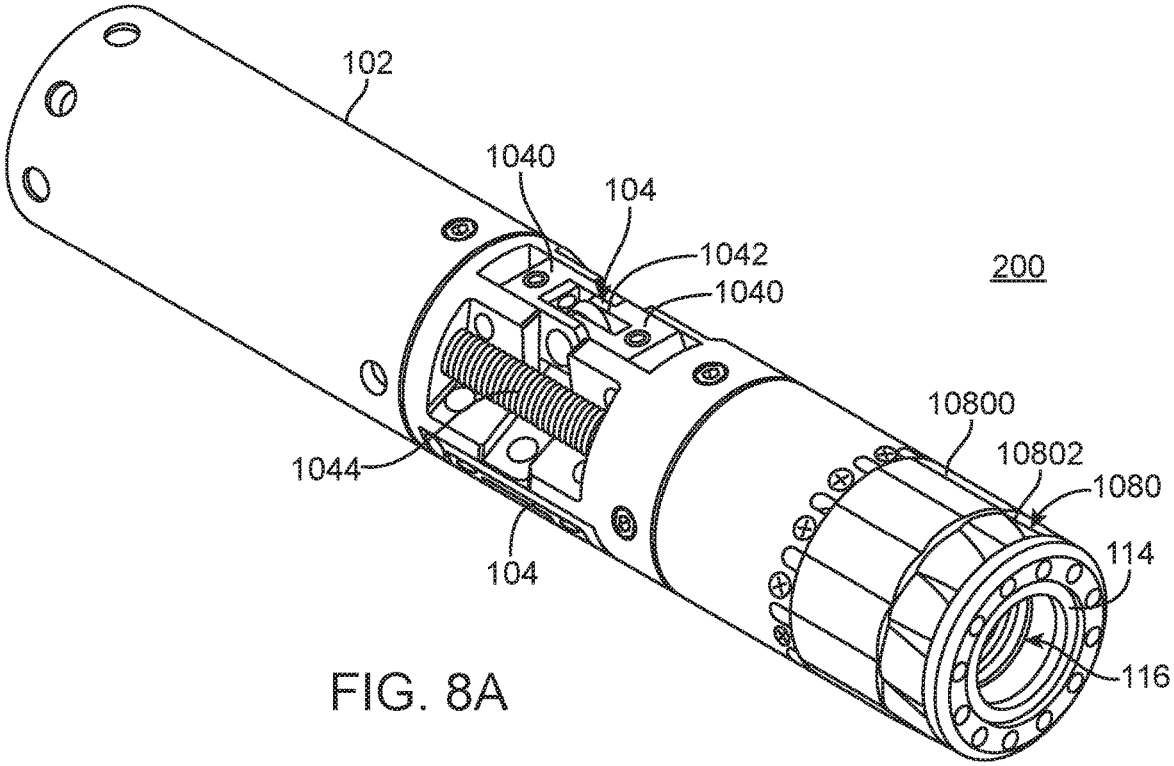
FIG. 8A is a partial, isometric of a wellbore isolation device showing an anti-extrusion device and a plurality of centralizing arms in a retracted configuration.

FIG. 8A illustrates the centralizing arms 104 and the anti-extrusion device 108 in the retracted configuration 200. In this configuration, the centralizing arms 104 and the anti-extrusion device 108 are not radially extended from the outer housing 102 or the tubular body 114. Further, the springs 1044 are not compressed and provide a force to prevent the centralizing arms 104 from pivoting and radially extending. The anti-extrusion device 108 also can include a plurality of outer panels 10800 and a plurality of inner panels 10802. The inner panels 10802 are provided along the edge of the elastomeric sealing surface 110.

Figure 8B:
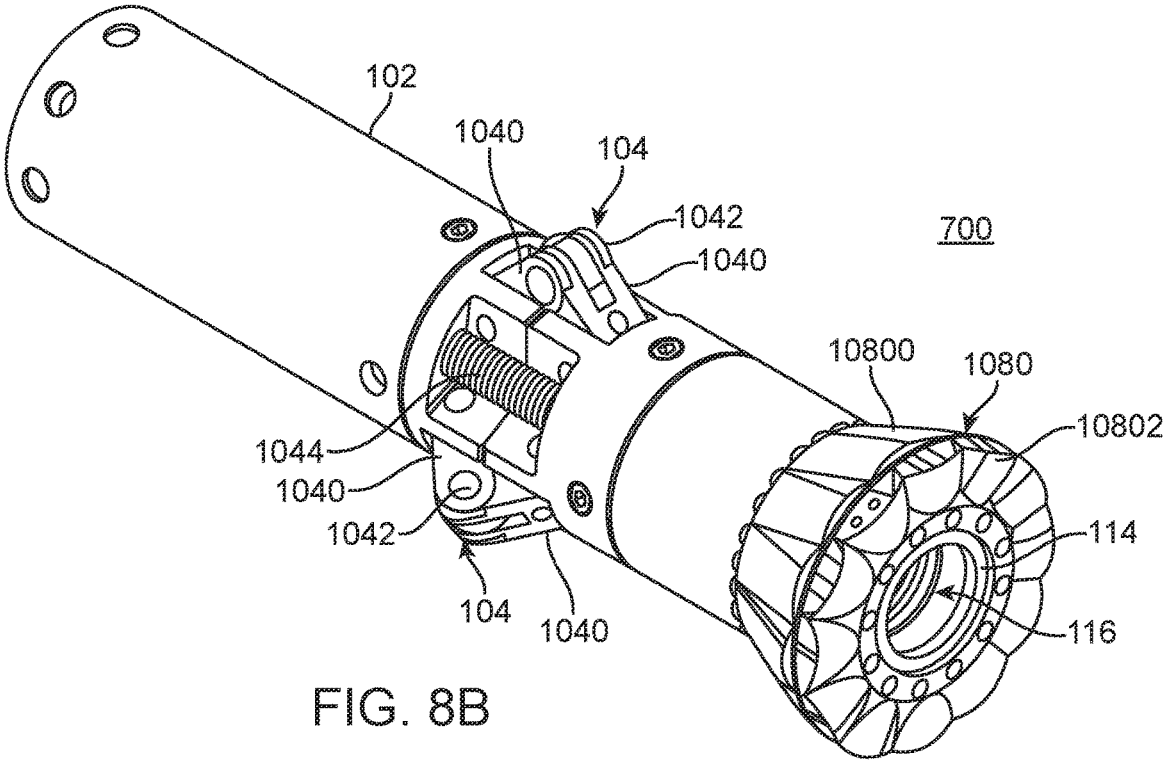
FIG. 8B is a partial, isometric of a wellbore isolation device showing an anti-extrusion device and a plurality of centralizing arms in an extended configuration.

When the outer tubing 102 compresses, the centralizing arms 104 and the anti-extrusion device 108 transition to the extended configuration 700, as shown in FIG. 8B. The centralizing arms 104 and the anti-extrusion device 108 radially extend as described above. As illustrated in FIG. 8B, the outer panels 10800 pivot radially and fan out. To provide a seal, the outer panels 10800 overlap such that, when extended, fluid cannot communicate across the outer panels 10800. The inner panels 10802 fold radially inward to provide a seal.

Figure 9A:
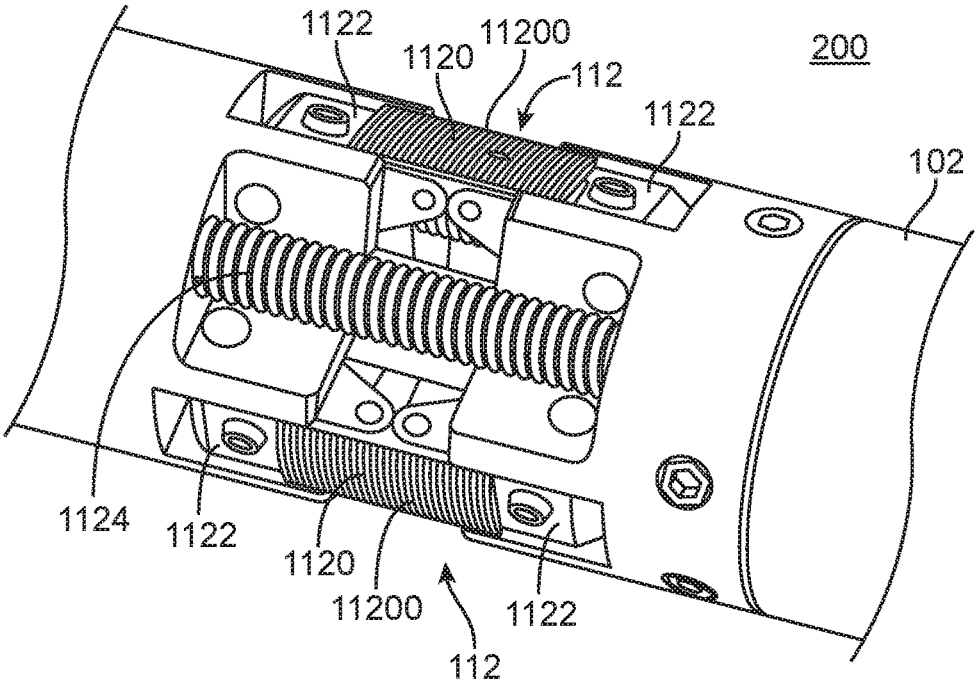
FIG. 9A is a partial, isometric view of a wellbore isolation device showing at least one slip in a retracted configuration.
Figure 9B:
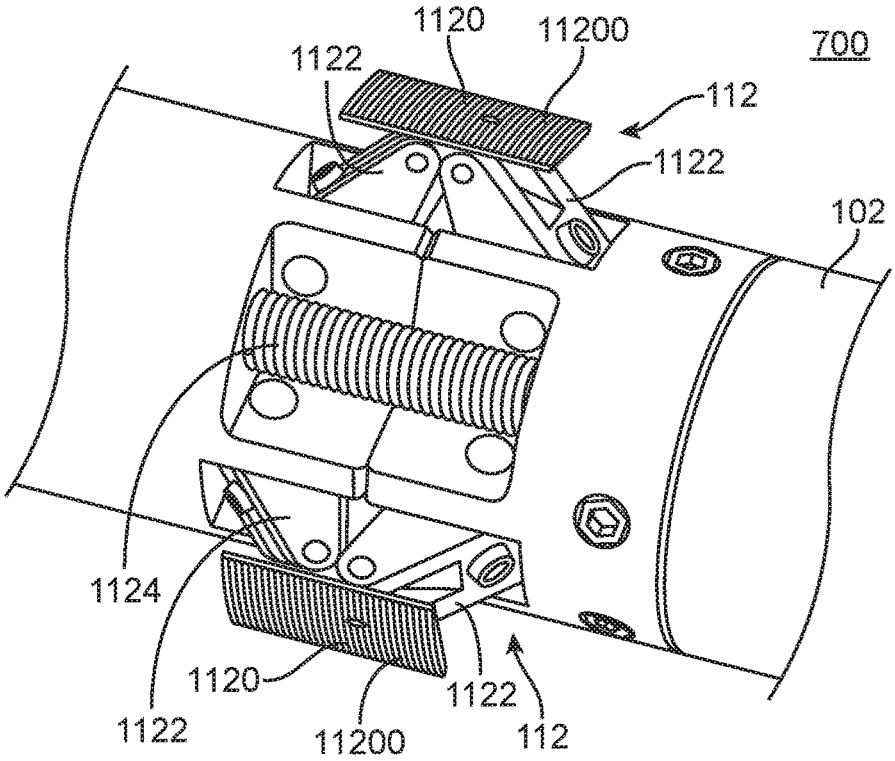
FIG. 9B is a partial, isometric view of a wellbore isolation device showing at least one slip in an extended configuration.

As shown in FIG. 9A, the at least one slip 112 is in the retracted configuration 200 and are not radially extended from the outer housing 102 or the tubular body 114. When in the extended configuration 700, the at least one slip radially extends and engages the wellbore as shown in FIG. 9B. The two arms 1122 pivot, as described above, and the engaging surface 1120 extends radially. The engaging surface 1120 can have teeth 11200 that engage the wellbore (which may include the casing) to prevent the wellbore isolation device 100 from moving out of position.

Figure 10:
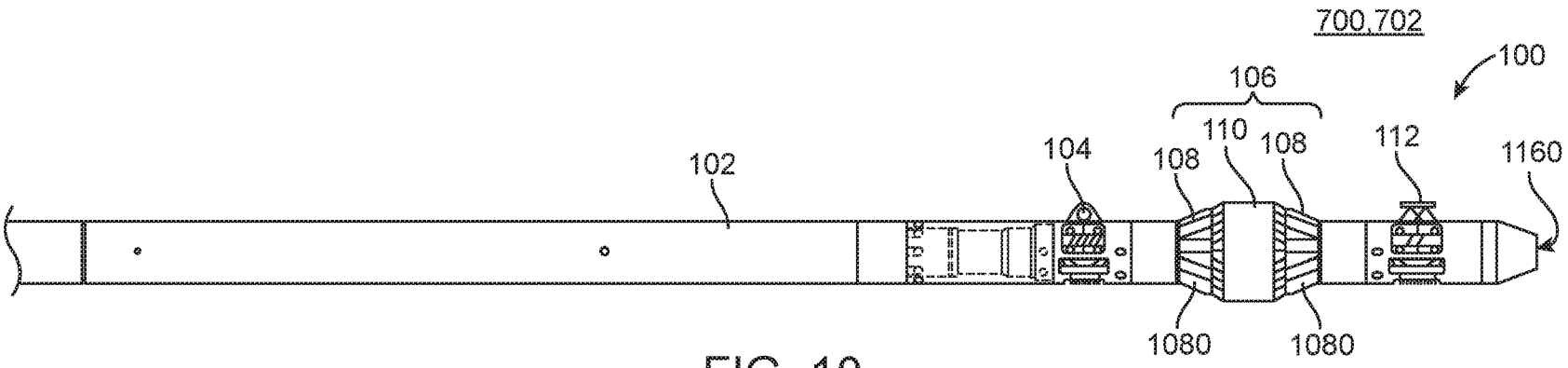
FIG. 10 is a diagram illustrating a wellbore isolation device.

FIG. 10 illustrates a diagram of the wellbore isolation device 100 where the outer housing 102 is in the contracted state 702. The centralizing arms 104, the sealing assembly 106, and the slips 112 are in the extended configuration 700.

Figure 11:
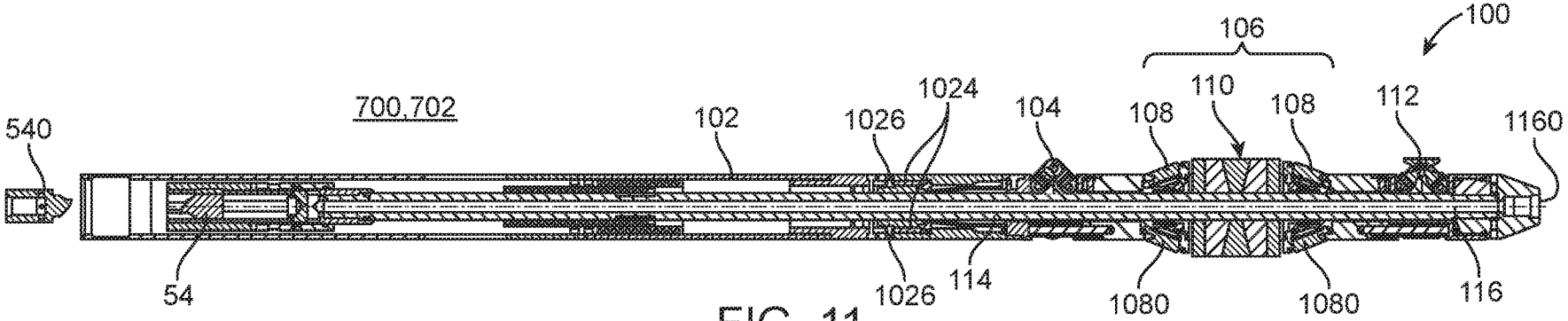
FIG. 11 is a cross-sectional view of a wellbore isolation device.

After the centralizing arms 104, the sealing assembly 106, and the slips 112 are in the extended configuration 700, the weak link 54 is broken, as shown in FIG. 11. A portion 540 of the broken weak link 54 remains attached to the downhole tool 50. The downhole tool 50 is then retrieved uphole, and the wellbore isolation device 100 is set in the wellbore to create zonal isolation.

Figure 12A:
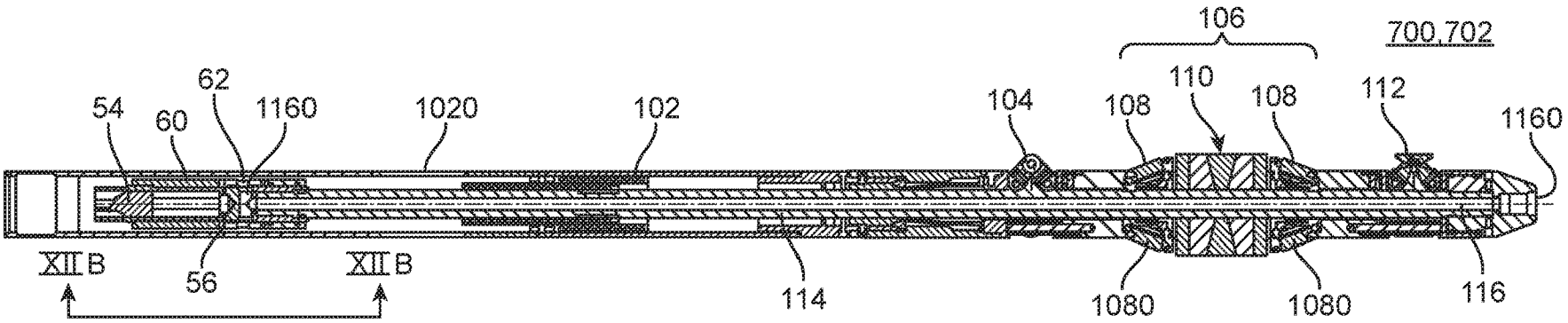
FIG. 12A is a cross-sectional view of a wellbore isolation device.
Figure 12B:
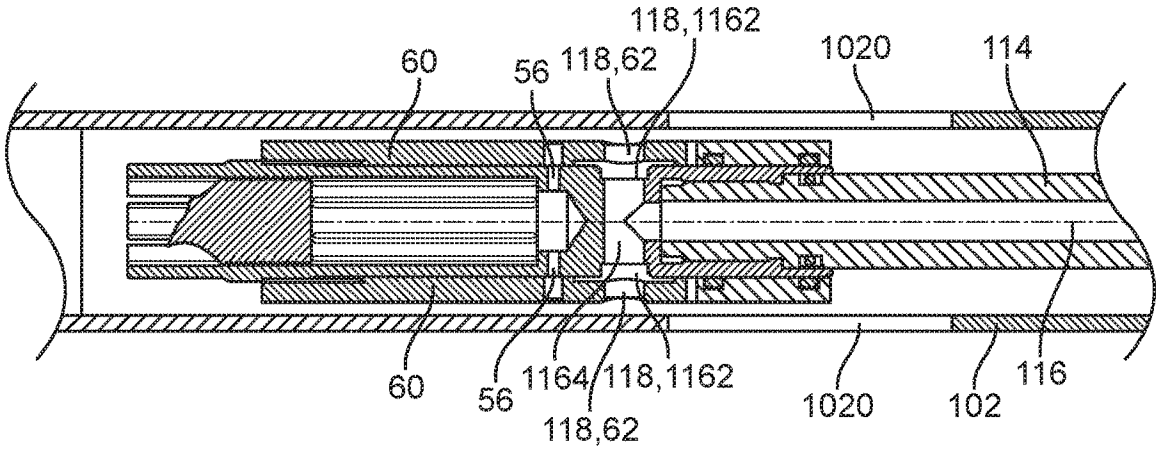
FIG. 12B is an enlarged, cross-sectional view of a wellbore isolation device taken from section XIIB-XIIB of FIG. 12A.
Figure 13A:
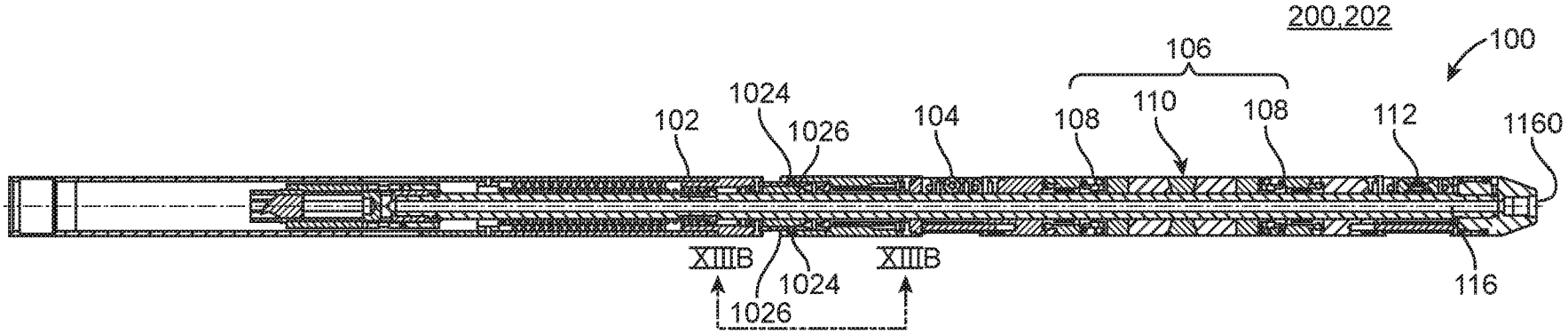
FIG. 13A is a cross-sectional view of a wellbore isolation device.

When the wellbore isolation device 100 is to be released and retrieved, a retrieving tool (not shown) couples to the uphole end of the wellbore isolation device 100 and imparts a breaking force thereupon. The equalizing port 118 opens, as shown in FIG. 12A. The retrieving tool can be tubing-conveyed, wireline, slickline, work string, coiled tubing, or any other suitable means for conveying downhole tools into a wellbore. An enlarged view of the equalizing port 118 is illustrated in FIG. 12B. The breaking force shears the sleeve fasteners 56, and the slidable sleeve 60 shifts. The first aperture 62 aligns with the second aperture 1162 which permits fluid communication between external the tubular body 114 and the inner bore 116. Fluid can flow between external the tubular body 114, the first aperture 62, the second aperture 1162, the channel 1164, the inner bore 116, and the opening 1160 (shown in FIG. 12A). As such, fluid can flow longitudinally across the sealing assembly 106. Thus, differential pressures that were formed by the seal on the uphole side of the sealing assembly 106 and the downhole side of the sealing assembly 106 are equalized. Equalizing the differential pressures prevents the wellbore isolation device 100 from being forced uphole or downhole as the sealing assembly 106 and the slip 112 are retracted as shown in FIG. 13A.

Figure 13B:
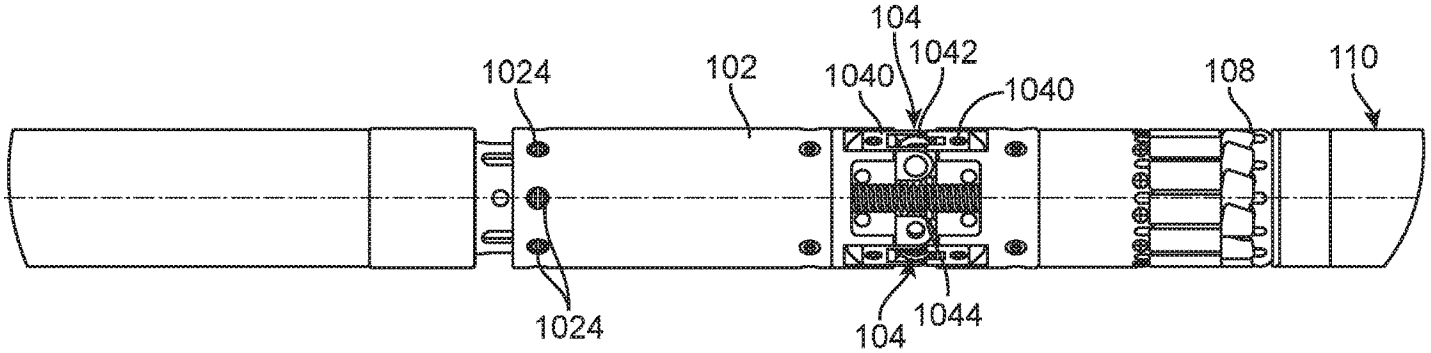
FIG. 13B is an enlarged diagram illustrating a wellbore isolation device taken from section XIIIB-XIIIB of FIG. 13A.

Along with the sleeve fasteners 45, the breaking force also shears the teeth fasteners 1024. The non-helical teeth 1026 are then released. The springs 1080, 1044, 1124 expand and push the outer housing 102 to the expanded configuration 202. Also, the radially extendible elastomeric sealing surface 110 further provides force to expand the outer housing 102. The centralizing arms 104, the sealing assembly 106, and the slips 112 transition to the retracted configuration 200, which is also shown in FIG. 13B. The transitioning between the extended configuration 700 and the retracted configuration 200 permits the wellbore isolation device 100 to be easily retrieved.

Figure 14:
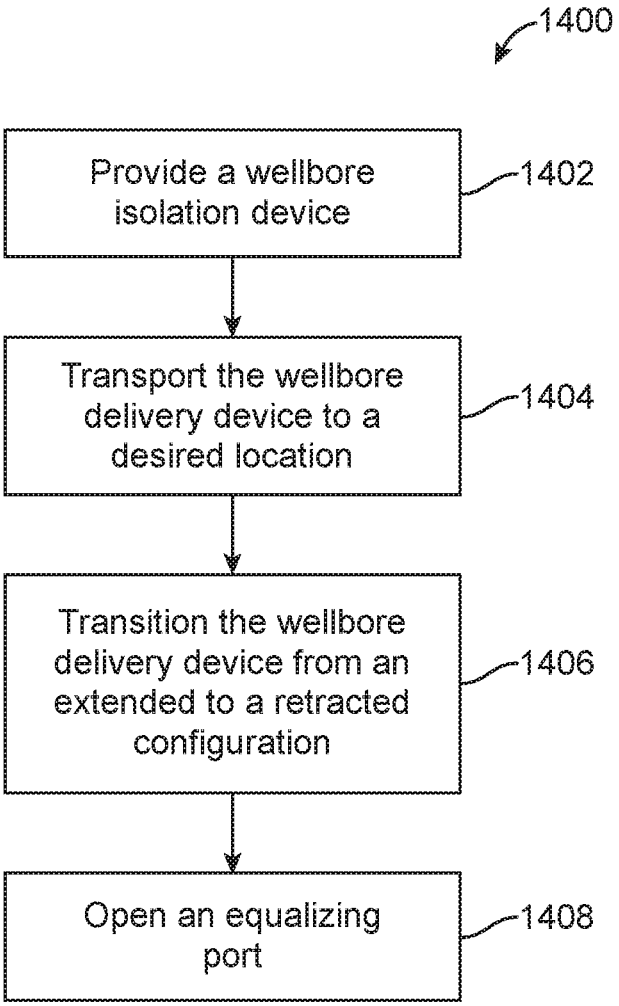
FIG. 14 is a flow chart of a method for utilizing a wellbore isolation device.

Referring to FIG. 14, a flowchart is presented in accordance with an example embodiment. The method 1400 is provided by way of example, as there are a variety of ways to carry out the method. The method 1400 described below can be carried out using the configurations illustrated in FIGS. 1-13B, for example, and various elements of these figures are referenced in explaining example method 1400. Each block shown in FIG. 14 represents one or more processes, methods or subroutines, carried out in the example method 1400. Furthermore, the illustrated order of blocks is illustrative only and the order of the blocks can change according to the present disclosure. Additional blocks may be added or fewer blocks may be utilized, without departing from this disclosure. The example method 900 can begin at block 1402.

At block 1402, a wellbore isolation device is provided. The wellbore isolation device includes an outer housing and a tubular body therewithin. The tubular body has an inner bore formed longitudinally therethrough. The wellbore isolation device also include a plurality of centralizing arms radially extendible from the tubular body, at least one slip radially extendible from the tubular body, and a sealing assembly radially extendible from the tubular body and disposed between the centralizing arms and the slip. The inner bore longitudinally traverses the sealing assembly. The sealing assembly includes a radially extendible elastomeric sealing surface and an anti-extrusion device which has at least two support members coupled to opposite longitudinal ends of the elastomeric sealing surface. The wellbore isolation device also includes an equalizing port disposed in the tubular body that permits, when opened, fluidic communication between external the tubular body and the inner bore.

At block 1404, the wellbore isolation device is transported to a desire location. The wellbore isolation device is coupled to a downhole tool which is coupled to a conveyance. The conveyance can be, for example, tubing-conveyed, wireline, slickline, work string, coiled tubing, or any other suitable means for conveying downhole tools into a wellbore.

Once the wellbore isolation device is at the desired location, at block 1406, the wellbore isolation device is transitioned from an extended to a retracted configuration. The downhole tool deploys the wellbore isolation device. The outer housing is compressed to a contracted configuration. The centralizing arms, the sealing assembly, and the slips engage the sides of the wellbore, for example casing.

When the centralizing arms are extended radially and engage the wellbore, the wellbore isolation device is positioned substantially in the center of the wellbore. The sealing assembly, when extended radially and engaging the wellbore, provides zonal isolation by an impermeable barrier. The sealing assembly includes a radially extendible elastomeric sealing surface made up of at least two elastomers alternatingly coupled along a longitudinal axis. As such, the elastomeric sealing surface provides a seal as well as decreases extrusion of the elastomeric sealing surface. The slips, when extended radially and engaging the wellbore, maintain the position of the wellbore isolation device. The slips prevent the differential pressure that may occur across the sealing assembly from moving the wellbore isolation device.

When the wellbore isolation device is to be retrieved, at block 1408, the equalizing port is opened, and the wellbore isolation device is transitioned from the extended configuration to the retracted configuration. Also, the outer housing is transitioned from the contracted configuration to the expanded configuration. When the equalizing port opens, fluid can communicate between external the tubular body on an uphole side relative to the sealing assembly, the inner bore, and external the tubular body on a downhole side relative to the sealing assembly. As such, differential pressures that may form across the sealing assembly are equalized which prevents the wellbore isolation device from being forced uphole or downhole as the sealing assembly and slip are retracted. When returned to the retracted configuration, the wellbore isolation device is then retrieved.

Numerous examples are provided herein to enhance understanding of the present disclosure. A specific set of statements are provided as follows.

Statement 1: A wellbore isolation device comprising: a tubular body having an inner bore formed longitudinally therethrough; a plurality of centralizing arms radially extendible from the tubular body; a sealing assembly radially extendible from the tubular body and disposed between the plurality of centralizing arms and the at least one slip, the sealing assembly comprising: a radially extendible elastomeric sealing surface; and an anti-extrusion device having at least two support members coupled to opposite longitudinal ends of the elastomeric sealing surface; and an equalizing port disposed in the tubular body that permits, when opened, fluidic communication between external the tubular body and the inner bore thereby equalizing the pressure between external the tubular body and the inner bore.

Statement 2: A wellbore isolation device is disclosed according to Statement 1, wherein when the plurality of centralizing arms, the at least one slip, and the sealing assembly transition from an extended to a retracted configuration, the equalizing port is opened.

Statement 3: A wellbore isolation device is disclosed according to Statement 2, further comprising a slidable sleeve at least partially encircling the tubular body; wherein the equalizing port comprises a first aperture in the slidable sleeve with a second aperture in the tubular which align when the equalizing port is opened.

Statement 4: A wellbore isolation device is disclosed according to Statements 1-3, wherein the tubular body has an uphole side and a downhole side relative to the sealing assembly; wherein the equalizing port is disposed in the uphole side of the tubular body, and the inner bore longitudinally traverses the sealing assembly.

Statement 5: A wellbore isolation device is disclosed according to Statements 1-4, further comprising an outer housing in which the tubular body is disposed, wherein the plurality of centralizing arms, the at least one slip, and the sealing assembly radially extend from the outer housing.

Statement 6: A wellbore isolation device is disclosed according to Statement 5, wherein the outer housing has a contracted and expanded configuration, wherein the plurality of centralizing arms, the at least one slip, and the sealing assembly transition from an extended to a retracted configuration and the equalizing port opens when the outer housing transitions from the expanded configuration to the contracted configuration.

Statement 7: A wellbore isolation device is disclosed according to Statements 1-6, the elastomeric sealing surface comprises at least five portions along a longitudinal axis, the five portions comprising: a middle portion; two side portions coupled to opposite sides of the middle portion; and two outer portions coupled to the two side portions, each of the two outer portions forming an outer end of the five portions, wherein the middle portion and the two outer portions comprise a first elastomer, and wherein the two side portions comprise a second elastomer, the second elastomer being stiffer than the first elastomer.

Statement 8: A wellbore isolation device is disclosed according to Statement 7, wherein the middle portion has oblique boundaries with the side portions.

Statement 9: A system comprising: a wellbore isolation device disposed in a wellbore, the wellbore isolation device comprising: a tubular body having an inner bore formed longitudinally therethrough; a plurality of centralizing arms radially extendible from the tubular body; at least one slip radially extendible from the tubular body; a sealing assembly radially extendible from the tubular body and disposed between the plurality of centralizing arms and the at least one slip, the sealing assembly comprising: a radially extendible elastomeric sealing surface; and an anti-extrusion device having at least two support members coupled to opposite longitudinal ends of the elastomeric sealing surface; and an equalizing port disposed in the tubular body that permits, when opened, fluidic communication between external the tubular body and the inner bore thereby equalizing the pressure between external the tubular body and the inner bore.

Statement 10: A system is disclosed according to Statement 9, wherein when the plurality of centralizing arms, the at least one slip, and the sealing assembly transition from an extended to a retracted configuration, the equalizing port is opened.

Statement 11: A system is disclosed according to Statement 10, further comprising a slidable sleeve at least partially encircling the tubular body; wherein the equalizing port comprises a first aperture in the slidable sleeve with a second aperture in the tubular body which align when the equalizing port is opened.

Statement 12: A system is disclosed according to Statements 9-11, wherein the tubular body has an uphole side and a downhole side relative to the sealing assembly; wherein the equalizing port is disposed in the uphole side of the tubular body, and the inner bore longitudinally traverses the sealing assembly.

Statement 13: A system is disclosed according to Statements 9-12, further comprising an outer housing in which the tubular body is disposed, wherein the plurality of centralizing arms, the at least one slip, and the sealing assembly radially extend from the outer housing.

Statement 14: A system is disclosed according to Statement 13, wherein the outer housing has a contracted and expanded configuration, wherein the plurality of centralizing arms, the at least one slip, and the sealing assembly transition from an extended to a retracted configuration and the equalizing port opens when the outer housing transitions from the expanded configuration to the contracted configuration.

Statement 15: A system is disclosed according to Statements 9-14, the elastomeric sealing surface comprises at least five portions along a longitudinal axis, the five portions comprising: a middle portion; two side portions coupled to opposite sides of the middle portion; and two outer portions coupled to the two side portions, each of the two outer portions forming an outer end of the five portions, wherein the middle portion and the two outer portions comprise a first elastomer, and wherein the two side portions comprise a second elastomer, the second elastomer being stiffer than the first elastomer.

Statement 16: A system is disclosed according to Statement 15, wherein the middle portion has oblique boundaries with the side portions.

Statement 17: A method comprising: providing a wellbore isolation device, the wellbore isolation device comprising: a tubular body having an inner bore formed longitudinally therethrough; a plurality of centralizing arms radially extendible from the tubular body; at least one slip radially extendible from the tubular body; a sealing assembly radially extendible from the tubular body and disposed between the plurality of centralizing arms and the at least one slip; the inner bore longitudinally traversing the sealing assembly, the sealing assembly comprising: a radially extendible elastomeric sealing surface; an anti-extrusion device having at least two support members coupled to opposite longitudinal ends of the elastomeric sealing surface; and an equalizing port disposed in the tubular body that permits, when opened, fluidic communication between external the tubular body and the inner bore thereby equalizing the pressure between external the tubular body and the inner bore; transporting the wellbore isolation device to a desired location in a wellbore; transitioning the plurality of centralizing arms, the at least one slip, and the sealing assembly transition from an extended to a retracted configuration; and opening, when the plurality of centralizing arms, the at least one slip, and the sealing assembly transition from an extended to a retracted configuration, the equalizing port.

Statement 18: A method is disclosed according to Statement 17, further comprising a slidable sleeve at least partially encircling the tubular body; wherein the equalizing port comprises a first aperture in the slidable sleeve with a second aperture in the tubular body which align when the equalizing port is opened.

Statement 19: A method is disclosed according to Statements 17-18, the elastomeric sealing surface comprises at least five portions along a longitudinal axis, the five portions comprising: a middle portion; two side portions coupled to opposite sides of the middle portion; and two outer portions coupled to the two side portions, each of the two outer portions forming an outer end of the five portions, wherein the middle portion and the two outer portions comprise a first elastomer, and wherein the two side portions comprise a second elastomer, the second elastomer being stiffer than the first elastomer.

Statement 20: A method is disclosed according to Statement 19, wherein the middle portion has oblique boundaries with the side portions.

The embodiments shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

What is claimed is:

1. A wellbore isolation device comprising:

a tubular body having an inner bore formed longitudinally therethrough;

a plurality of centralizing arms radially extendible from the tubular body;

at least one slip radially extendible from the tubular body;

a sealing assembly radially extendible from the tubular body and disposed between the plurality of centralizing arms and the at least one slip, the sealing assembly comprising:

a radially extendible elastomeric sealing surface; and an anti-extrusion device having at least two support members coupled to opposite longitudinal ends of the elastomeric sealing surface; and an equalizing port disposed in the tubular body that permits, when opened, fluidic communication between external the tubular body and the inner bore thereby equalizing the pressure between external the tubular body and the inner bore, wherein when the plurality of centralizing arms, the at least one slip, and the sealing assembly transition from an extended to a retracted configuration, the equalizing port is opened.

2. The wellbore isolation device of claim 1, further comprising a slidable sleeve at least partially encircling the tubular body; wherein the equalizing port comprises a first aperture in the slidable sleeve with a second aperture in the tubular body which align when the equalizing port is opened.

3. The wellbore isolation device of claim 1, wherein the tubular body has an uphole side and a downhole side relative to the sealing assembly; wherein the equalizing port is disposed in the uphole side of the tubular body, and the inner bore longitudinally traverses the sealing assembly.

4. The wellbore isolation device of claim 1, further comprising an outer housing in which the tubular body is disposed, wherein the plurality of centralizing arms, the at least one slip, and the sealing assembly radially extend from the outer housing.

5. The wellbore isolation device of claim 4, wherein the outer housing has a contracted and expanded configuration, wherein the plurality of centralizing arms, the at least one slip, and the sealing assembly transition from an extended to a retracted configuration and the equalizing port opens when the outer housing transitions from the expanded configuration to the contracted configuration.

6. The wellbore isolation device of claim 1, the elastomeric sealing surface comprises at least five portions along a longitudinal axis, the five portions comprising:

a middle portion;

two side portions coupled to opposite sides of the middle portion; and two outer portions coupled to the two side portions, each of the two outer portions forming an outer end of the five portions, wherein the middle portion and the two outer portions comprise a first elastomer, and wherein the two side portions comprise a second elastomer, the second elastomer being stiffer than the first elastomer.

7. The wellbore isolation device of claim 6, wherein the middle portion has oblique boundaries with the side portions.

8. A system comprising:

a wellbore isolation device disposed in a wellbore, the wellbore isolation device comprising:

a tubular body having an inner bore formed longitudinally therethrough;

a plurality of centralizing arms radially extendible from the tubular body;

at least one slip radially extendible from the tubular body;

a sealing assembly radially extendible from the tubular body and disposed between the plurality of centralizing arms and the at least one slip, the sealing assembly comprising:

a radially extendible elastomeric sealing surface; and an anti-extrusion device having at least two support members coupled to opposite longitudinal ends of the elastomeric sealing surface; and an equalizing port disposed in the tubular body that permits, when opened, fluidic communication between external the tubular body and the inner bore thereby equalizing the pressure between external the tubular body and the inner bore, wherein when the plurality of centralizing arms, the at least one slip, and the sealing assembly transition from an extended to a retracted configuration, the equalizing port is opened.

9. The system of claim 8, further comprising a slidable sleeve at least partially encircling the tubular body; wherein the equalizing port comprises a first aperture in the slidable sleeve with a second aperture in the tubular body which align when the equalizing port is opened.

10. The system of claim 8, wherein the tubular body has an uphole side and a downhole side relative to the sealing assembly; wherein the equalizing port is disposed in the uphole side of the tubular body, and the inner bore longitudinally traverses the sealing assembly.

11. The system of claim 8, further comprising an outer housing in which the tubular body is disposed, wherein the plurality of centralizing arms, the at least one slip, and the sealing assembly radially extend from the outer housing.

12. The system of claim 11, wherein the outer housing has a contracted and expanded configuration, wherein the plurality of centralizing arms, the at least one slip, and the sealing assembly transition from an extended to a retracted configuration and the equalizing port opens when the outer housing transitions from the expanded configuration to the contracted configuration.

13. The system of claim 8, the elastomeric sealing surface comprises at least five portions along a longitudinal axis, the five portions comprising:

a middle portion;

two side portions coupled to opposite sides of the middle portion; and two outer portions coupled to the two side portions, each of the two outer portions forming an outer end of the five portions, wherein the middle portion and the two outer portions comprise a first elastomer, and wherein the two side portions comprise a second elastomer, the second elastomer being stiffer than the first elastomer.

14. The system of claim 13, wherein the middle portion has oblique boundaries with the side portions.

15. A method comprising:

providing a wellbore isolation device, the wellbore isolation device comprising:

a tubular body having an inner bore formed longitudinally therethrough;

a plurality of centralizing arms radially extendible from the tubular body;

at least one slip radially extendible from the tubular body;

a sealing assembly radially extendible from the tubular body and disposed between the plurality of centralizing arms and the at least one slip; the inner bore longitudinally traversing the sealing assembly, the sealing assembly comprising:

a radially extendible elastomeric sealing surface; and an anti-extrusion device having at least two support members coupled to opposite longitudinal ends of the elastomeric sealing surface; and an equalizing port disposed in the tubular body that permits, when opened, fluidic communication between external the tubular body and the inner bore thereby equalizing the pressure between external the tubular body and the inner bore;

transporting the wellbore isolation device to a desired location in a wellbore;

transitioning the plurality of centralizing arms, the at least one slip, and the sealing assembly transition from an extended to a retracted configuration; and opening, when the plurality of centralizing arms, the at least one slip, and the sealing assembly transition from an extended to a retracted configuration, the equalizing port.

16. The method of claim 15, further comprising a slidable sleeve at least partially encircling the tubular body; wherein the equalizing port comprises a first aperture in the slidable sleeve with a second aperture in the tubular body which align when the equalizing port is opened.

17. The method of claim 15, the elastomeric sealing surface comprises at least five portions along a longitudinal axis, the five portions comprising:

a middle portion;

two side portions coupled to opposite sides of the middle portion; and two outer portions coupled to the two side portions, each of the two outer portions forming an outer end of the five portions, wherein the middle portion and the two outer portions comprise a first elastomer, and wherein the two side portions comprise a second elastomer, the second elastomer being stiffer than the first elastomer.

18. The method of claim 17, wherein the middle portion has oblique boundaries with the side portions.

* * * * *